US006209444B1

(12) United States Patent
Murakami et al.

(10) Patent No.: US 6,209,444 B1
(45) Date of Patent: Apr. 3, 2001

(54) PISTON-OPERATED REFRIGERANT COMPRESSOR AND A METHOD OF ASSEMBLING THE SAME

(75) Inventors: Kazuo Murakami; Toshiro Fujii; Naoya Yokomachi; Takayuki Imai, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/253,597

(22) Filed: Feb. 22, 1999

(30) Foreign Application Priority Data

Mar. 3, 1998 (JP) ..... 10-051038

(51) Int. Cl.[7] ..... F01B 3/00
(52) U.S. Cl. ..... 92/71; 92/169.1
(58) Field of Search ..... 92/71, 169.1; 91/499; 417/269

(56) References Cited

U.S. PATENT DOCUMENTS 4,729,719 3/1988 Kayukawa et al. ..... 417/222
5,282,725 * 2/1994 Shimizu ..... 417/222.1
5,393,204 * 2/1995 Kawahara ..... 417/269

* cited by examiner

*Primary Examiner*—Edward K. Look
*Assistant Examiner*—Thomas E. Lazo
(74) *Attorney, Agent, or Firm*—Woodcock Washburn Kurtz Mackiewicz & Norris LLP

(57) ABSTRACT

A piston-operated refrigerant compressor provided with pistons fitted with piston rings and reciprocating in cylinder bores of a cylinder block having a central boss portion formed in an inner end face thereof confronting a crank chamber for receiving a cam or swash plate mounted on a drive shaft, and the central boss portion of the cylinder block defining therein a plurality of axially projecting lip portions formed at a portion of each bore end of the cylinder bore for permitting the diameter of the piston ring to be compressively reduced during inserting of the piston into the corresponding cylinder bore at the assembling stage of the refrigerant compressor either in cooperation with a piston-assembling jig provided with guide bores to promote a smooth insertion of each piston together with the piston ring into the corresponding cylinder bore or without cooperation of the piston-assembling jig.

10 Claims, 5 Drawing Sheets

PISTON-OPERATED REFRIGERANT COMPRESSOR AND A METHOD OF ASSEMBLING THE SAME

BACKGROUND OF THE INVENTION

1. Field of the Invention

The present invention relates to a piston-operated refrigerant compressor having at least one compressing piston provided with a piston ring fitted therein and to a method of assembling the piston-operated refrigerant compressor and, particularly, to a method of assembling the pistons in the cylinder bores of the compressor.

2. Description of the Related Art

In known refrigerant compressors and, particularly, refrigerant compressors accommodated in a vehicle climate control system, carbon dioxide gas ($CO_2$ gas) is practically used as a refrigerant gas instead of the conventional fluorinated hydrocarbons gas, to prevent environmental problems. When $CO_2$ gas is used as a refrigerant gas for the compressor of the vehicle climate control system, the gas must be compressed to a relatively high pressure in order to exhibit a refrigerating performance suitable for cooling air in the vehicle compartment. Therefore, it is required that an annular gap between the cylindrical inner wall of each cylinder bore and the outer circumference of each piston is gas-tightly sealed to achieve an effective compression of the $CO_2$ gas while preventing an increase in an amount of blow-by gas through the gap. Further, a smooth reciprocation of the piston in the cylinder bore must be maintained. Accordingly, the sealing of the annular small gap between the bore wall of the cylinder bore and the outer circumference of the piston must be achieved by a sealing means more effective than the conventional simple sealing method in which the piston and the bore wall of the cylinder bore is maintained in a snug fitting condition without using any particular sealing elements. Thus, adoption of a piston ring for sealing the gap between each piston and the bore wall of the cylinder bore of the refrigerant compressor, which was not adopted in the field of the conventional fluorinated hydrocarbons gas type refrigerant compressors, has been recently reconsidered.

When a refrigerant compressor uses reciprocating pistons fitted with piston rings in circumferential grooves therein, the outer diameter of each piston ring in a free and non-compressed condition is formed larger than the inner diameter of the bore wall of the cylinder bore to obtain a good sealing performance. Therefore, when the compressor is assembled and when the respective pistons with the piston rings are fitted in the cylinder bores, the piston rings must be compressed to reduce the outer diameter thereof before the pistons and the piston rings are inserted into the respective cylinder bores of a cylinder block. For example, in the case of a single-headed piston type swash-plate-operated refrigerating compressor, when a piston unit including one set of pistons fitted with piston rings and assembled with a swash plate is inserted into the corresponding cylinder bores of the cylinder block, the ends of the respective cylinder bores opening toward a swash plate chamber of the compressor housing are chamfered to have tapered ends through which the pistons with the piston rings are forcedly inserted into the corresponding cylinder bores. In order to smoothly insert the pistons and the piston rings into the cylinder bores, the bore ends must be chamfered to have a large oblique face, respectively. Nevertheless, when the large oblique faces are formed in the respective bore ends, the length of each cylinder bore to smoothly guide the reciprocation of the pistons is reduced to result in a reduction in a reliable reciprocating operation of the respective pistons. Further, if an inclining angle of the oblique face of each bore end is increased to intentionally enlarge the diameter of the entrance of the bore end, the piston ring fitted in the piston cannot be in a smooth sliding contact with the oblique face of the bore end so that the piston and the piston ring are not smoothly inserted into the corresponding cylinder bore. Namely, assembling of the pistons and the piston rings into the cylinder block cannot be effectively achieved. Therefore, it cannot be said that the provision of the conventional chamfered oblique face at the bore end of each cylinder bore of the cylinder block of a refrigerant compressor is effective for improving the assembling operation of the piston unit into the cylinder bores of the cylinder block. Thus, when the piston unit is inserted into the cylinder bores of the cylinder block, the piston rings fitted in the respective pistons must be manually compressed from the outside to elastically reduce the diameter thereof before the pistons together with the piston rings are urged into the corresponding cylinder bores. Accordingly, it usually takes a long time to assemble the piston unit into the cylinder bores of the cylinder block. Particularly, radially inner portions of the respective cylinder bores arranged radially closer to the central bore of the cylinder block in which a drive shaft is mounted, must be arranged closer to one another in a circumferential direction, so that spacing between the neighboring radially inner portions of the two neighboring cylinder bores is considerably small from the viewpoint of the structural requirement of the cylinder block. Thus, the small spacings between the respective two neighboring inner portions of the cylinder bores cause a difficulty in the assembling of the pistons and the piston rings into the cylinder bores while compressing the piston rings either manually or by the use of a specified assembling jig.

SUMMARY OF THE INVENTION

Therefore, an object of the present invention is to provide a piston-operated refrigerant compressor provided with reciprocatory pistons fitted with piston rings, and having an internal structure allowing easy assembly of the pistons into corresponding cylinder bores of a cylinder block.

Another object of the present invention is to provide a simplified method of assembling reciprocatory pistons fitted with piston rings into corresponding cylinder bores of a cylinder block of a piston-operated refrigerant compressor.

In accordance with one aspect of the present invention, there is provided a piston-operated refrigerant compressor including:

a cylinder block having a central axis and a plurality of cylinder bores arranged in parallel with one another and equiangularly around the central axis;

a drive shaft rotatably supported in a central portion of the cylinder block and supporting thereon a cam plate to be rotatable together with the drive shaft within a crank chamber; and a plurality of pistons fitted in the cylinder bores of the cylinder block to be reciprocated in the cylinder bores in association with the rotation of the cam plate, each of the plurality of pistons being fitted with a piston ring in a circumferential groove formed therein, wherein the cylinder block is centrally provided with an inner end face confronting an interior of the crank chamber and having bore ends of the plurality of cylinder bores lying therein, the inner end face being centrally provided with a boss portion axially projecting into the interior of the crank chamber and defining a circularly extending lip portion of each of the bore ends of the cylinder bores to urge the piston together with the piston ring into the corresponding cylinder bore when assembling the piston and the piston ring into the corresponding cylinder bore.

Since the lip portion of each of the bore ends is provided so as to form a lower marginal portion of each bore end which is radially arranged adjacent to the drive shaft supported by the cylinder block and is axially extended with respect to the remaining upper marginal portion of each bore end, when the piston ring and the piston are assembled into the corresponding cylinder bore, the piston ring fitted in the circumferential groove with an non-compressed condition initially comes into contact with the lip portion of the bore end of the corresponding cylinder bore. Accordingly, a compression can be easily applied from the outside to the piston ring while the piston ring is kept in contact with the lip portion, to reduce the diameter of the piston ring. Thus, the diameter-reduced piston ring together with the piston can be smoothly inserted into the corresponding cylinder bore. Namely, the respective lip portions of the bore ends of the plurality of cylinder bores can be used as a sort of assembling tool for assembling the pistons fitted with the piston rings into the respective cylinder bores.

Preferably, the boss portion of the cylinder block is formed to have a round outer circumference, the diameter of which is substantially equal to that of a circle passing respective centers of the plurality of cylinder bores. Then, the round boss portion of the cylinder block can be machined easily by the use of a conventional lathe. Further, the circular lip portions of the bore ends formed in the round boss portion can provide a sufficient amount of support for stably guiding the piston rings into the respective cylinder bores during the assembling of the piston rings and the piston into the respective cylinder bores.

Preferably, the bore ends of the plurality of cylinder bores, lying in the inner end face of the cylinder block, are provided with a permissible amount of chamfer, respectively. Then, the respective chamfers of the bores ends of the cylinder bores can be very effective for smooth insertion of the pistons and the piston rings into the cylinder bores.

In accordance with another aspect of the present invention, there is provided a method of assembling a piston-operated refrigerant compressor including: a cylinder block having a central axis and a plurality of cylinder bores arranged in parallel with one another and equiangularly around the central axis; a drive shaft rotatably supported in a central portion of the cylinder block and supporting thereon a cam plate to be rotatable together with the drive shaft within a crank chamber; and a plurality of pistons fitted in the cylinder bores of the cylinder block to be reciprocated in the cylinder bores due to rotation of the cam plate, each of the plurality of pistons being fitted with a piston ring in a circumferential groove formed therein, respectively, in which the cylinder block is centrally provided with an inner end face confronting an interior of the crank chamber and having bore ends of the plurality of cylinder bores lying therein, the inner end face being centrally provided with a boss portion axially projecting into the interior of the crank chamber and defining a circularly extending lip portion of each of the bore ends of the cylinder bores to allow the piston together with the piston ring to be easily inserted into the cylinder bore, and wherein the method is characterized by a process of assembling the pistons fitted with the piston rings into the respective cylinder bores, the process comprising the steps of:

preparing a piston-assembling jig separable into two halves and provided with guide bores, each having the shape of an arcuate bore smaller than a semi-circular bore and having a bore diameter thereof substantially the same as that of each cylinder bore, the guide bores being able to come into registration with radially outer arcuate portions of all of the plurality of cylinder bores of the cylinder block when the piston-assembling jig is brought into contact with the inner end face of the cylinder block;

attaching the piston-assembling jig to the inner end face of the cylinder block so that guide bores are in registration with all of the bore ends of the cylinder bores of the cylinder block;

inserting the pistons and the piston rings into the respective cylinder bores via the guide bores of the piston-assembling jig while compressing the respective piston rings by the cooperation of the guide bores and the circularly extending lip portions of the bore ends of the cylinder bores to thereby reduce the diameter of the piston rings; and, after inserting all of the pistons fitted with the piston rings into the respective cylinder bores, separating the piston-assembling jig into the two halves to detach the piston-assembling jig from the inner end face of the cylinder block.

Preferably, the bore ends of the plurality of cylinder bores, lying in the inner end face of the cylinder block of the compressor, are provided with a permissible amount of a chamfer formed thereat, respectively, and the guide bores of the piston-assembling jig are provided with a chamfered portion sufficient for promoting a smooth reduction in the diameter of the piston rings when the pistons fitted with the piston rings are urged into the respective cylinder bores.

It will be understood that, by the use of the above-mentioned piston-assembling jig, all of the plurality of the pistons fitted with the piston rings and assembled on a variable inclination cam plate supported on a drive shaft of a variable capacity piston-operated refrigerant compressor can be assembled into the corresponding cylinder bores of the cylinder block at a single assembling stage.

BRIEF DESCRIPTION OF THE DRAWINGS

The above and other objects, features, and advantages of the present invention will be made more apparent from the ensuing description of preferred embodiments in conjunction with the accompanying drawings wherein.

DESCRIPTION OF THE PREFERRED EMBODIMENTS

Figure 1A:
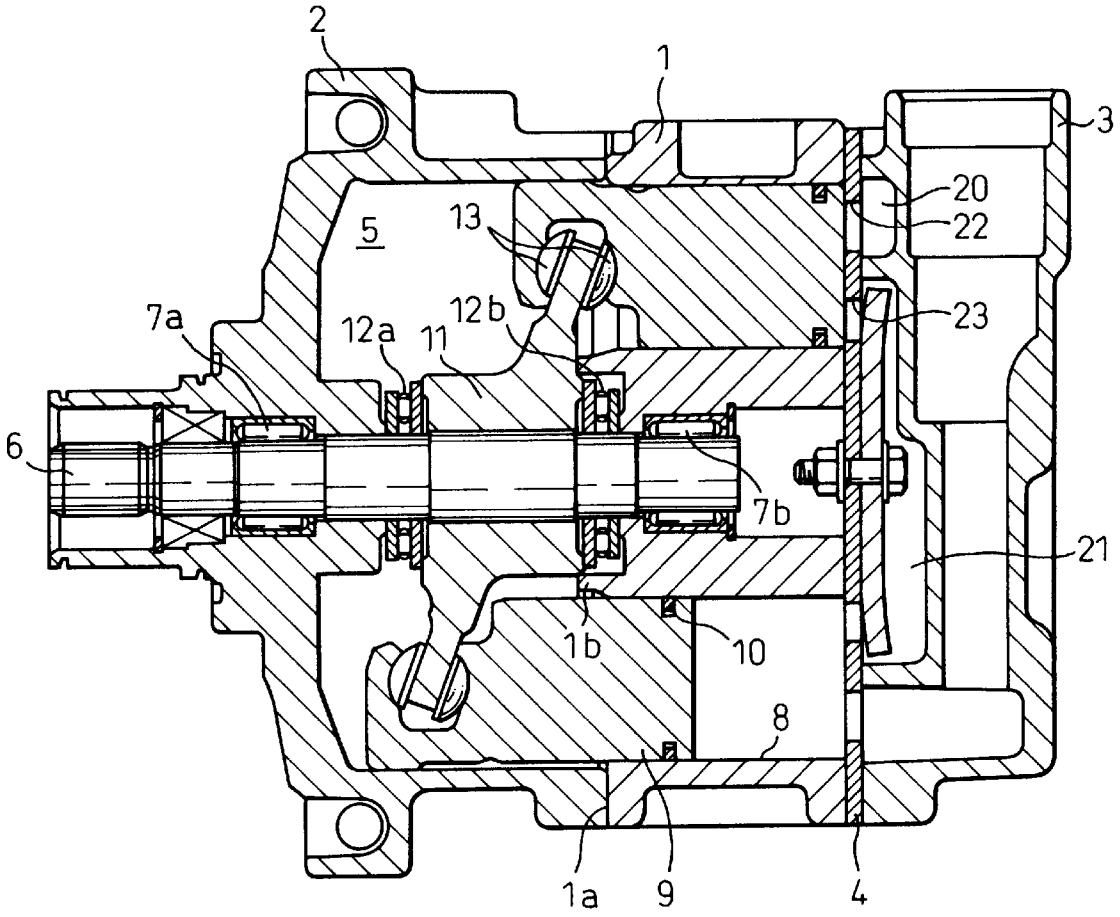
FIG. 1A is a longitudinal cross-sectional view of a piston-operated refrigerant compressor provided with pistons fitted with piston rings and a fixed-inclination-type swash plate, according to an embodiment of the present invention.

Referring to FIG. 1, a piston-operated refrigerant compressor formed as a fixed capacity refrigerant compressor is provided with a cylinder block 1 having an inner end face confronting a later-described crank chamber of the compressor and an outer end face to which a later-described valve plate 4 is secured. The inner end face of the cylinder block 1 is closed by a bell-jar like front housing 2 which is hermetically affixed to the inner end face of the cylinder block 1. The outer end of the cylinder block 1 is hermetically closed by a rear housing 3 via the valve plate 4. The cylinder block 1 and the front housing 2 define a closed chamber therein, conventionally referred to as a crank chamber 5, through which an axial drive shaft 6 extends so as to be rotatably supported by the cylinder block 1 and the front housing 2 via front and rear radial bearings 7*a* and 7*b*. Namely, the drive shaft 6 can rotate about an axis of rotation which extends through the centers of the front and rear radial bearings 7*a* and 7*b*.

The cylinder block 1 is provided with a plurality of cylinder bores 8 which are arranged in parallel with one another and substantially equiangularly about the axis of rotation of the drive shaft 6. The cylinder bores 8 of the cylinder block 1 have an equal bore diameter and an equal axial length, respectively, in which a plurality of single-headed pistons 9 fitted with piston rings 10 made of an iron system material are fitted. The pistons 9 having the piston rings 10 perform a reciprocating motion in the respective cylinder bores 8, by which a refrigerant gas is sucked from a later-described suction chamber 20, compressed therein, and is discharged therefrom into a later-described discharge chamber 21.

A circular cam plate, i.e., a swash plate 11 is fixedly mounted on the drive shaft 6 so as to be rotated together with the drive shaft 6 within the crank chamber 5. The swash plate 11 is sandwiched by the cylinder block 1 and the front housing 2 via a pair of front and rear thrust bearings 12*a* and 12*b*. An outer marginal portion of the swash plate 11 is positioned between confronting flat faces of two semi-spherical shoe elements 13, 13 received in a pair of support recesses formed in an end of each of the plurality of pistons 9. Thus, the two shoe elements 13 form one of a plurality of pairs of shoes 13, 13 received in the plurality of pistons 9.

The rear housing 3 attached to the outer end face of the cylinder block 1 via the valve plate 4 defines a suction chamber 20 for receiving a refrigerant gas before compression and a discharge chamber 21 for receiving the refrigerant gas after compression. The suction chamber 20 communicates with each of the cylinder bores 8 via each suction port Z2 formed in a relevant portion of the valve plate 4, and the discharge chamber 21 also communicates with each of the cylinder bores 8 via each discharge port 23 formed in a relevant portion of the valve plate 4. Each of the cylinder bores 8 forms a compression chamber between the operating head of the corresponding piston 9 and the face of the valve plate 4 so that the refrigerant gas is compressed within the compression chamber. The suction ports 22 of the valve plate 4 are closed by suction valves (not shown in FIG. 1) held between the outer end face of the cylinder block 1 and the valve plate 4 to be opened when the pistons 9 perform their suction stroke motion within the cylinder bores 8. The discharge ports 23 of the valve plate 4 are closed by discharge valves (not shown in FIG. 1) held between the valve plate 4 and the end of the rear housing 3 to be opened when the pistons 9 perform their discharge stroke motion within the cylinder bores 8. The refrigerant compressor according to the embodiment of FIG. 1A is characterized in that the cylinder block 1 has a specified novel construction suitable for permitting the pistons 9 fitted with the piston rings 10 to be inserted into the cylinder bores 8 without any difficulty, and accordingly, the assembly of the entire piston-operated refrigerant compressor can be accomplished with high efficiency.

The description of the specified construction of the cylinder block 1 of the compressor of FIG. 1A will be provided later with reference to FIGS. 2 and 3. However, before referring to the specified construction of the cylinder block 1, the description of a piston-operated refrigerant compressor of a different embodiment will be set forth below with reference to FIG. 1B.

Figure 1B:
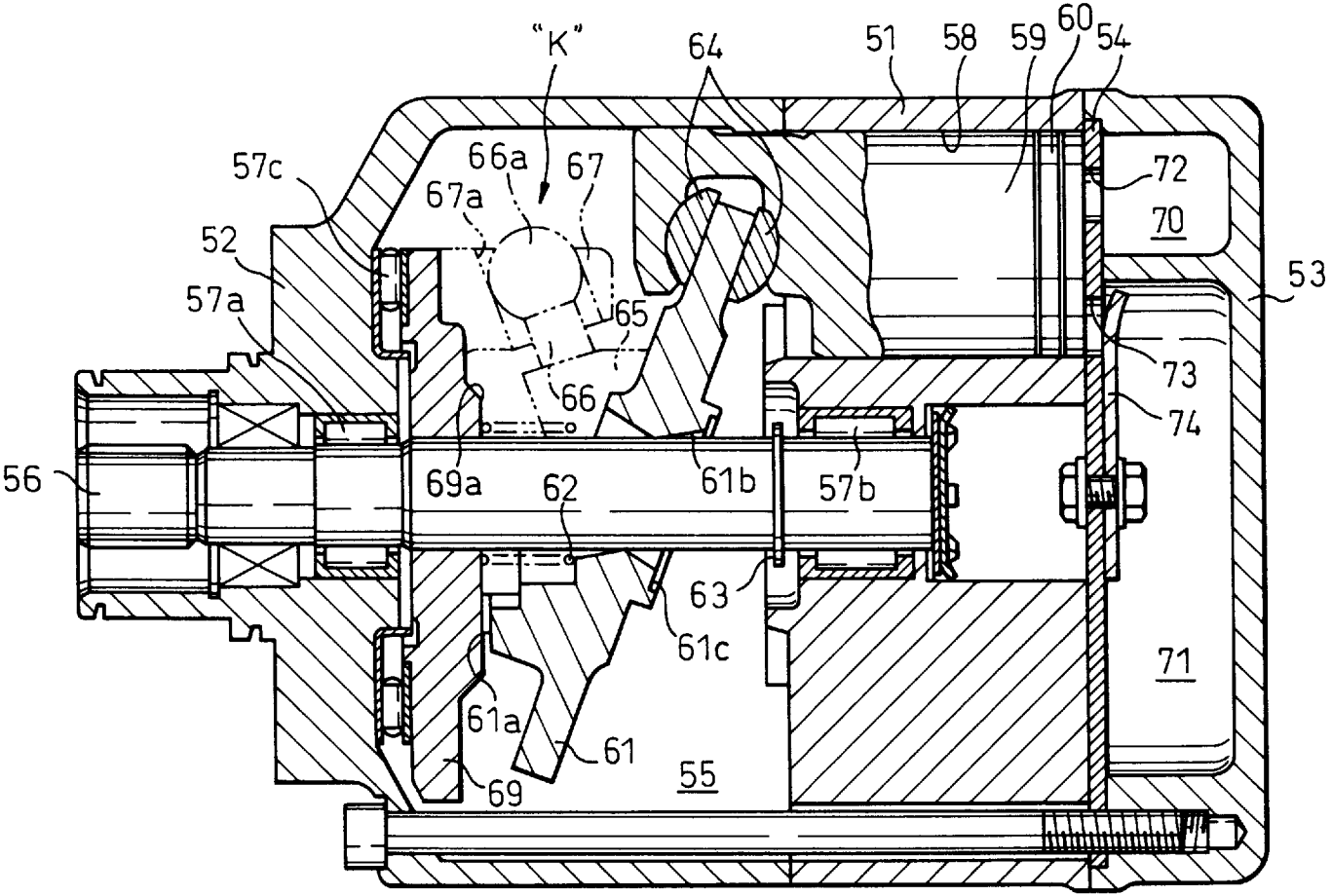
FIG. 1B is a longitudinal cross-sectional view of a piston-operated refrigerant compressor provided with pistons fitted with piston rings and a variable-inclination-type swash plate, according to a different embodiment of the present invention.

Referring to FIG. 1B, a variable capacity type piston-operated refrigerant compressor, which has a cam plate formed as a variable inclination type swash plate, has a cylinder block 51 having axially opposite ends, i.e., an inner (front) end face and an outer (rear) end face. The inner end face of the cylinder block 51 is closed by a bell-shaped front housing 52 hermetically secured to the cylinder block 51, and the outer end face of the cylinder block 51 is closed by a rear housing 53 also hermetically secured to the cylinder block 51 via a valve plate 54. The cylinder block 51 and the front housing 52 define an interior crank chamber 55 located in front of the inner end face of the cylinder block 51. The crank chamber 55 is formed so as to permit a drive shaft 56 to axially extend therethrough. The drive shaft 56 is rotatably supported by the front housing 52 and the cylinder block 51 via a front radial bearing 7*a* and a rear radial bearing 7*b*. A frontmost end of the drive shaft 56 extends toward a front opening of the front housing 52 so as to receive an external drive force from a non-illustrating drive source such as an automobile engine. When driven, the drive shaft 56 rotates about its central axis of rotation to thereby operate the compressor.

The cylinder block 51 is provided with a plurality of cylinder bores 58 extending axially from the inner end face to the outer end face. The cylinder bores 58 are arranged equiangularly around the axis of rotation of the drive shaft 56, and in parallel with one another. The respective cylinder bores 58 receive therein single headed pistons 59 respectively fitted with piston rings 60, so that the pistons 59 with piston rings 60 are slidable within the cylinder bores 58 of the cylinder block 51.

The drive shaft 56 has a rotor element 69 fixedly mounted thereon at a position adjacent to an inner end wall of the front housing 52 via a thrust bearing 57*c*. Thus, the rotor element 69 is rotated together with the drive shaft 56 within the crank chamber 55.

A swash plate element 61 is mounted on the drive shaft 56 at a position spaced rearwardly from the rotor element 69 within the crank chamber 55. The swash plate element 61 is provided with a substantially central bore 61*b* through which the drive shaft 56 axially extends.

The central bore 61*b* of the swash plate 61 has an axially non-linear cylindrical shape and is formed in a bore consisting of a combination of two different bores which are slanted from an axis perpendicular to end faces of the swash plate element 61. The two slanted bores forming the central bore 61*b* of the swash plate element 61 permit the swash plate 61 to turn about a predetermined axis to thereby change an angle of inclination of the swash plate 61 from a minimum angle of inclination to a maximum angle of inclination.

A coil spring 62 is arranged between the rotor element 69 and the swash plate element 61 for constantly rearwardly urging the swash plate element 61. The swash plate element 61 is provided with outer portion which is engaged with respective pistons 59 via semi-spherical shoes 64, 64 having a half-spherical engaging faces fitted in spherical recesses formed in respective pistons 59, as typically shown by one of the pistons in FIG. 1. Thus, when the swash plate element 61 is rotated together with the drive shaft 56 via the rotor element 69, the pistons 59 are reciprocated in the respective cylinder bores 58.

The swash plate element 61 is provided with a bracket 65 shown by a chain line in FIG. 1B, which is formed in a portion thereof on the front side. The bracket 65 in the shape of a projection is provided for forming a part of the hinge unit "K" between the swash plate element 61 and the rotor element 69. The bracket 65 is provided with an end portion to which an end of a guide pin 66 is secured. The guide pin 66 projects toward the rotor element 69, and has an outer end in which a spherical portion 66*a* is formed. The spherical portion 66*a* is received in an hole 67*a* of a support arm 67 formed in a portion of the rotor element 69 on the rear side thereof. As shown by a chain line in FIG. 1B, the support arm 67 projects toward the guide pin 66 of the swash plate element 61, and forms a part cooperating with the bracket 65 and the guide pin 66 in order to constitute the hinge unit "K".

The guide hole 67*a* of the support arm 67 is arranged to be parallel with a plane extending so as to contain therein the line of inclination of the swash plate element 61 and the axis of rotation of the drive shaft 56. The guide hole 67*a* is bored so as to radially extend toward and to be slanted rearwardly when it approaches toward the axis of rotation of the drive shaft 56. The guide hole 67*a* of the support arm 67 receiving therein the spherical portion 66*a* of the hinge unit "K" has a center line thereof which is provided so that when the swash plate element 61 changes its angle of inclination under the restrained guide of the hinge unit "K", the position of the top dead center of the respective pistons 59 operatively engaged with the swash plate element 61 is substantially unchanged.

The rear housing 53 is provided therein with a suction chamber 70 for receiving refrigerant gas before compression and a discharge chamber 71 for the compressed refrigerant gas. The suction and discharge chambers 70 and 71 are hermetically separated from one another. The valve plate 54 is provided with suction ports 72 formed therein for providing fluid communication between compression chambers formed in the respective cylinder bores 58 between the valve plate 54 and the operating heads of the respective pistons 59, and the suction chamber 70. The valve plate 54 is also provided with discharge ports 73 formed therein for providing fluid communication between the compression chambers in the respective cylinder bores 58 and the discharge chamber 71.

The suction ports 72 of the valve plate 54 are covered by conventional suction valves e.g., suction reed valves which open and close in response to the reciprocation of the pistons 59, and the discharge ports 73 of the valve plate 54 are covered by conventional discharge valves, e.g., discharge reed valves which open and close in response to the reciprocation of the pistons 59. The rear housing 53 receives therein a control valve (not shown) for controlling a pressure prevailing in the crank chamber 55. A typical control valve is disclosed in U.S. Pat. No. 4,729,719 to Kayukawa et al., and is assigned to the same assignee as the present application.

The variable inclination type swash plate element 61 is provided with a counter bore 61*b* which is provided to come into contact with a stop ring 63 secured to a rear portion of the drive shaft 56 when the swash plate 61 is moved to the position of the minimum angle of inclination.

On the other hand, the position of the maximum angle of inclination of the swash plate element 61 is limited when a contacting area 61*a* of the swash plate element 61 comes into contact with a cooperating contacting area 69*a* formed in the rotor element 69 during the increase in the angle of inclination of the swash plate 61.

When the variable capacity refrigerant compressor having the above-mentioned internal construction is operated by the rotation of the drive shaft 56, the swash plate 61 connected to the rotor element 69 via the hinge unit "K" is rotated together with the drive shaft 56. Therefore, the single headed pistons 9 fitted with the piston rings 60 are reciprocated in the respective cylinder bores 58 via the shoes 64, 64. Thus, the refrigerant gas is sucked from the suction chamber 70 into the compression chambers of the respective cylinder bores 58 via the suction ports 72. The sucked refrigerant gas is compressed within the compression chambers of the respective cylinder bores 58, and is discharged from the respective cylinder bores 58 into the discharge chamber 71. The capacity of the compressed refrigerant gas discharged into the discharge chamber 71 is controlled by the control valve which controls the pressure level within the crank chamber 55.

When the pressure prevailing in the crank chamber 5 is increased by the operation of the control valve, the pressure acting on the back of the respective pistons 59 increases. Thus, the stroke of the respective pistons 59 is reduced to reduce an angle of inclination of the swash plate element 61. Namely, in the hinge unit "K", the spherical portion 66*a* of the guide pin 66 is rotationally slid down in the guide hole 67*a* of the support arm 67 toward the axis of the drive shaft 56. Accordingly, the swash plate element 61 is turned about its pivotal axis, and is moved rearwardly by the spring force of the coil spring 62 along the outer circumference of the drive shaft 56. Namely, the swash plate element 61 is linearly slid on the drive shaft 56. Therefore, the angle of inclination of the swash plate element 61 is reduced and, accordingly, the capacity of the compressed refrigerant gas discharged from the compression chambers of the respective cylinder bores 58 is reduced. The position of the minimum angle of inclination of the swash plate element 61 is limited when the counter bore 61*b* of the swash plate element 61 comes into contact with the stop ring 63 fixed to the rear portion of the drive shaft 56.

On the other hand, when the compressor operates at a small capacity condition, and when the pressure level in the crank chamber 55 is reduced by the pressure adjusting operation of the control valve, the pressure acting on the back of the respective pistons 59 is decreased to cause an increase in the angle of inclination of the swash plate element 61. Thus, the spherical portion 66*a* of the guide pin 66 of the hinge unit "K" is rotationally moved up in the guide hole 67*a* of the support arm 67 of the hinge unit "K". Therefore, the swash plate element 61 is moved forwardly against the spring force of the coil spring 62 while maintaining slide contact of the swash plate element 61 with the outer circumference of the drive shaft 56. Thus, the angle of inclination of the swash plate element 61 is increased to increase the stroke of the respective pistons 59. Accordingly, the capacity of the compressor is increased. The position of the maximum angle of inclination is limited by the inclination limiting means, i.e., by the engagement of the contacting area 61*a* of the swash plate element 61 and the rear contacting area 69*a* of the rotor element 69.

The above-described variable capacity piston-operated refrigerant compressor of the embodiment of FIG. 1B is also characterized in that the cylinder block 51 similar to the cylinder block 1 of the embodiment of FIG. 1A has a specified construction suitable for permitting the pistons 59 fitted with the piston rings 60 to be inserted into the cylinder bores 58 by an assembler without any difficulty, and accordingly, the assembly of the entire piston-operated refrigerant compressor can be accomplished at a high efficiency.

Figure 2:
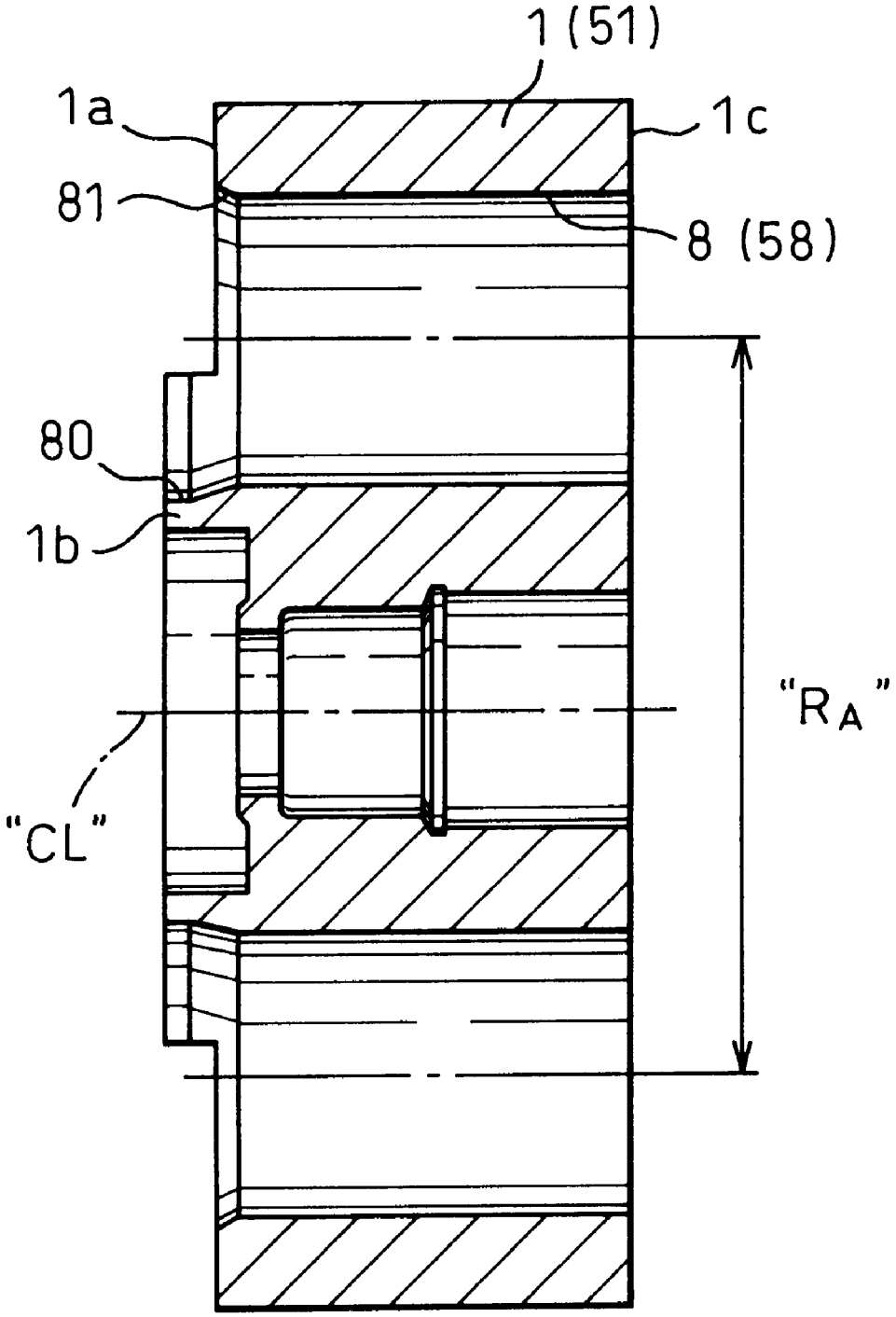
FIG. 2 is a cross-sectional view of a cylinder block assembled in either one of the compressors of FIGS. 1A and 1B, and illustrating a lip portion formed in a central boss portion of an inner end face of the cylinder block.
Figure 3:
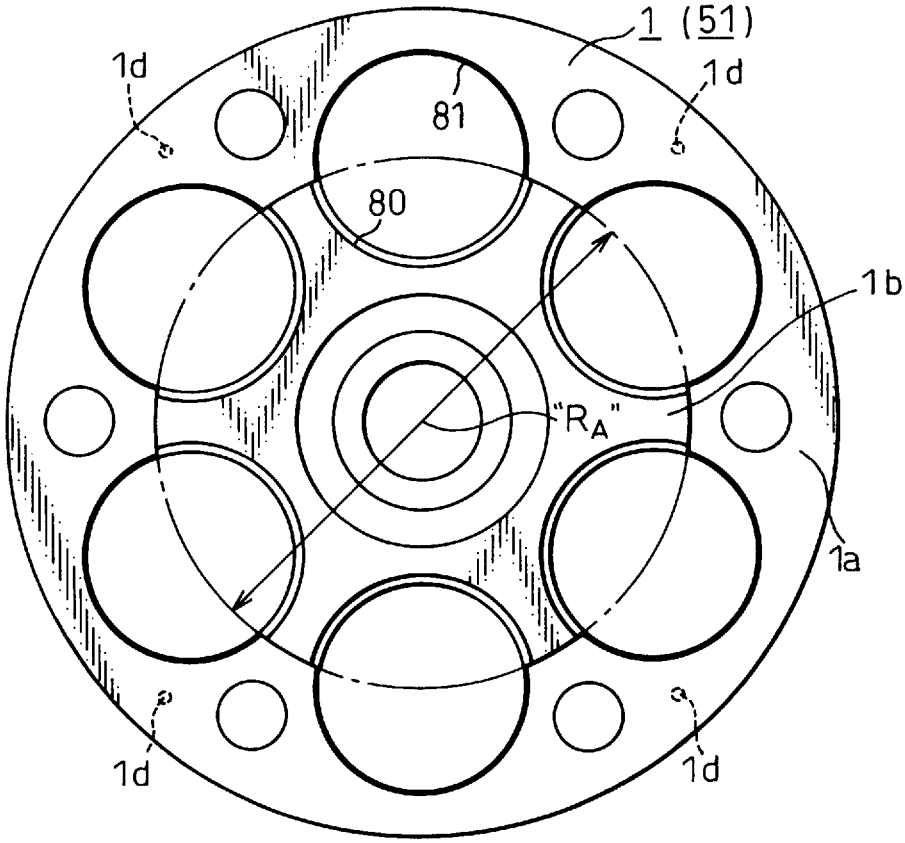
FIG. 3 is a side view of the inner end face of the cylinder block of FIG. 2, illustrating an arrangement of the cylinder bores provided with the lip portions formed in the bore ends thereof.

FIGS. 2 and 3 illustrate commonly the construction of the cylinder block 1 or 51 accommodated in the piston-operated compressor of FIG. 1A or 1B.

The cylinder block 1 or 51 is provided with a plurality of cylinder bores 8 or 58 formed therein to axially extend in parallel with a central axis "CL" of the cylinder block 1 or 51 and arranged substantially equiangularly around the central axis "CL". The cylinder block 1 or 51 has the inner end face 1*a* confronting the crank chamber 5 or 55 (see FIGS. 1A and 1B) and the outer end face 1*c* closed by the rear housing 3 or 53 via the valve plate 4 or 54 (see FIGS. 1A and 1B). The inner end face 1*a* of the cylinder block 1 or 51 is centrally provided with a boss portion 1*b* projecting axially from a plane in which an outer marginal portion of the inner end face 1*a* lies. The boss portion 1*b* of the inner end face 1*a* has its outermost circumference portion formed to have an outer diameter substantially equal to that "RA" of a circle passing the centers of the respective cylinder bores 8 or 58 as shown in FIG. 3. The outermost circumference of the boss portion 1*b* is formed so as to extend around the central axis of the cylinder block 1 or 51.

The boss portion 1*b* has also a plurality of rim-like portions each being formed as a circularly extending lip portion 80 which surrounds an inward part of the bore end of each cylinder bore 8 or 58 with respect to the central axis "CL" of the cylinder block 8 or 58. Thus, in the described embodiment, since the cylinder block 1 or 51 has equiangularly arranged six cylinder bores 8 or 58, the boss portion 1*b* is provided with six lip portions 80. The respective lip portions 80 of the boss portion 1*b* are preferably formed as an outwardly divergent oblique face, respectively, as will be understood from the illustration of FIGS. 2 and 3.

Further, the bore end of each cylinder bore 8 or 58 lying in the inner end face 1*a* of the cylinder block 1 or 51 is chamfered to provide an oblique face portion 81 in the shape of an outwardly diverging portion, shown by thick lines in FIG. 3. An extent of the oblique face portion 81 formed in the bore end of each cylinder bore 8 or 58 is determined so that each cylinder bore 8 or 58 may have an axial length sufficient for permitting each piston 9 or 59 to reciprocate within the cylinder bore 8 or 58 while conducting suction of an appropriate amount of refrigerant gas, compression of the sucked refrigerant gas, and discharge of the compressed refrigerant gas. It should be understood that, in the described embodiment, the oblique face 81 extends circularly through the entire portion of the bore end of each cylinder bore 8 or 58. Thus, the oblique portion 81 is formed so as to run through the afore-mentioned lip portion 80 of each cylinder bore 8 or 58 as will be understood form the illustration of FIG. 2.

When the piston 9 or 59 fitted with the piston ring 10 or 60 in the non-compressed condition is inserted into the corresponding cylinder bore 8 or 58 of the cylinder block 1 or 51 from the inner end face 1*a* during the assembling of the piston-operated refrigerant compressor, the piston rings 10 or 60 fitted on the piston 9 or 59 initially come into contact with the semi-circular lip portion 80 of the bore end of the cylinder bore 8 or 58, so that a circular half portion of the piston ring 10 or 60 is supported by the lip portion 80 during the movement of the piston 9 or 59 with the piston ring 10 or 60 into the cylinder bore 8 or 58. Thus, it is not required that the assembler manipulates fingers in a narrow region around the inward part of the bore end of each cylinder bore 8 or 58 to reduce the diameter of the piston ring 10 or 60. Namely, when the assembler applies an appropriate compression to the piston ring 9 or 59 from a portion thereof which is located opposite to the circular half portion of the piston ring 10 or 60 supported by the lip portion 80 of the cylinder block 1 or 51, the diameter of the piston ring 10 or 60 is easily reduced within an annular groove of the piston 9 or 59. Then, the diameter-reduced piston ring 10 or 60 fitted on the piston 9 or 59 is brought into contact with the oblique face 81 of the bore end of the cylinder bore 8 or 58. Therefore, when the piston 9 or 59 is moved further into the cylinder bore 8 or 58, the piston 9 or 59 together with the piston ring 10 or 60 are smoothly fitted in the corresponding cylinder bore 8 or 58. Thus, the assembling of the piston 9 or 59 and the piston ring 10 or 60 into the cylinder bore 8 or 58 is accomplished.

Figure 4:
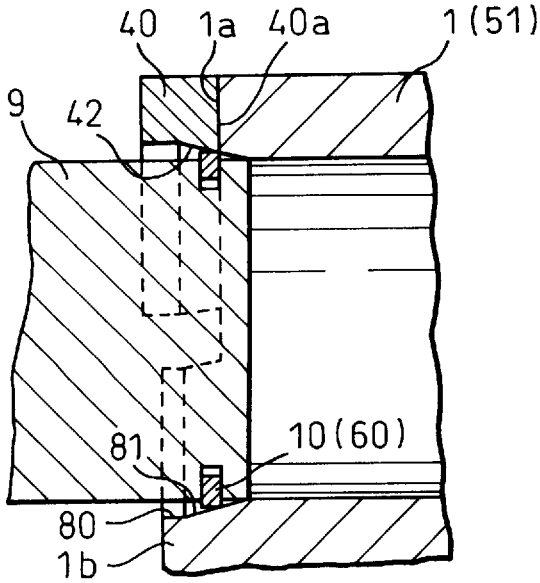
FIG. 4 is a partial cross-sectional view of a part of the cylinder block, illustrating a relationship between one of the cylinder bores and a piston assembling jig attached to the inner end face of the cylinder block when the piston fitted with piston rings are assembled into the cylinder bores from the side of the inner end face of the cylinder block.
Figure 5:
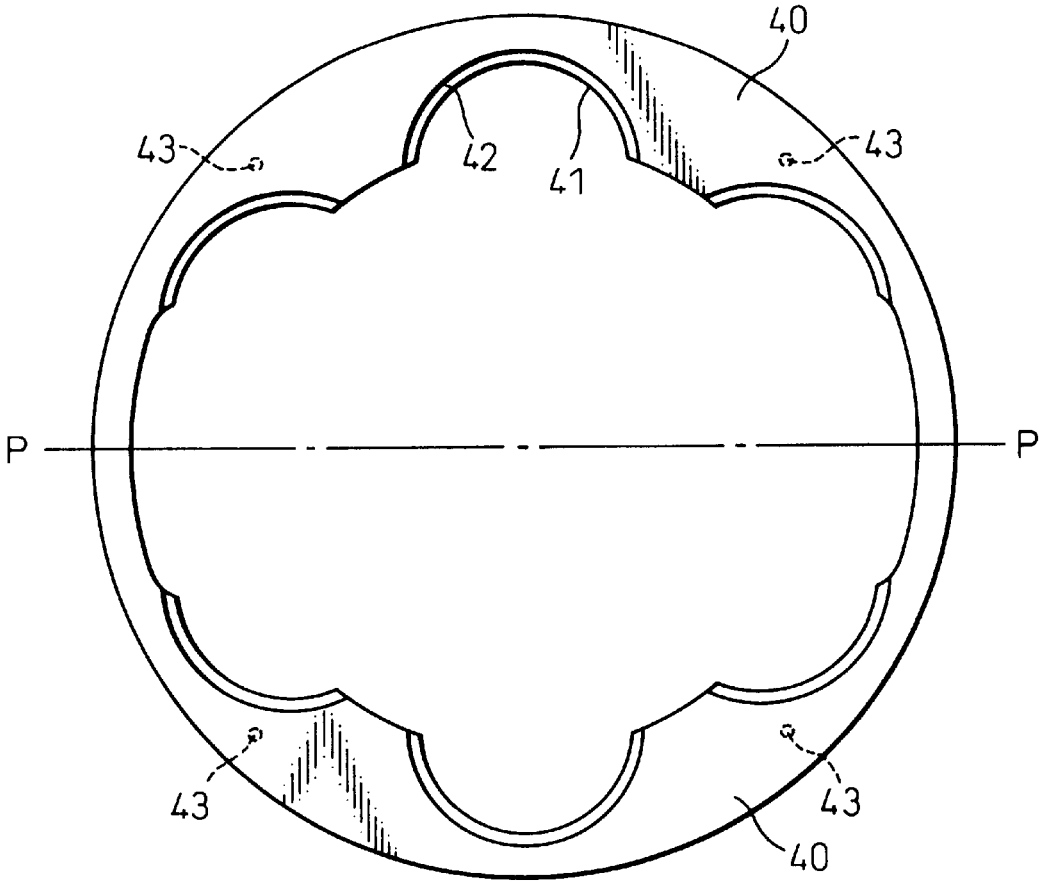
FIG. 5 is a side view of a piston assembling jig, illustrating an arrangement of guide bores, and a dividable construction thereof.

FIGS. 4 and 5 illustrate a specified method of assembling the piston 9 or 59 fitted with the piston ring 10 or 60 into the cylinder bore 8 or 58 according to the present invention. Namely, in the method, a piston-assembling jig 40 is used for smoothly assembling a plurality of the pistons 9 or 59 and the piston rings 10 or 60 into a plurality of the cylinder bores 8 or 58 at a single assembling stage.

The piston-assembling jig 40 is formed as a generally circular disk like tool dividable into two halves along a line P—P as shown in FIG. 5. The jig 40 includes guide bores 41 which are arranged so as to be in registration with the cylinder bores 8 or 58 of the cylinder block 1 or 51. Each of the guide bores 41 of the piston-assembling jig 40 is shaped in a partial circular bore having a diameter substantially equal to that of each of the cylinder bores 8 or 58 and an arcuate inner edge portion smaller than a semi-circular inner edge. The arcuate inner edge of each of the guide bores 41 is chamfered to have an oblique face 42 extending inwardly divergently from one of the opposite end faces of the piston-assembling jig 40, i.e., an end face 40*a* by which the piston-assembling jig 40 is attached to the inner end face 1*a* of the cylinder block 1 or 51, as best shown in FIG. 4. The lengths of respective arcuate edge portions of the guide bores 41 are designed so that the two halves of the piston-assembling jig 40 can be easily separated from one another along the line P—P (see FIG. 5) without any mechanical interference with the pistons 9 or 59 even when all of the guide bores 41 hold therein the pistons 9 or 59 to be assembled into the cylinder block 1 or 51.

When the plurality of pistons 9 or 59 (e.g., six pistons) provided with the piston rings 10 or 60 are assembled into the corresponding number of the cylinder bores 8 or 58, the piston-assembling jig 40 is initially placed on the inner end face 1*a* of the cylinder block 1 or 51 which is disposed at a state where the inner and outer end faces 1*a* and 1*c* of the cylinder block 1 or 51 are positioned up and down. Namely, the end face 40*a* of the piston-assembling jig 40 is brought into contact with the inner end face 1*a* of the cylinder block 1 or 51. Subsequently, an adjustment is carried out so that respective guide bores 41 of the piston-assembling jig 40 come into accurate registration with the cylinder bores 8 or 58 of the cylinder block 1 or 51. Thus, the oblique faces 42 of the guide bores 41 of the piston-assembling jig 40 coincide with the corresponding oblique faces 81 formed in the circular lip portions 80 of the cylinder bores 8 or 58, so that a substantially round oblique face is formed for each of the cylinder bores 8 or 58 as will be understood from FIG. 4. At this stage, the two halves of the piston-assembling jig 40 should be preferably provided with suitable projections or small pins 43 (refer to FIG. 5) which are engaged in positioning holes 1*d* (refer to FIG. 3) bored in the inner end face 1*a* of the cylinder block 1 or 51 to surely achieve the above-mentioned adjustment of the position of the guide bores 41 of the piston-assembling jig 40 with respect to the cylinder bores 8 or 58 of the cylinder block 1 or 51.

When the adjustment of the guide bores 41 with respect to the cylinder bores 8 or 58 is completed, the plurality of the pistons 9 or 59 fitted with the piston rings 10 and 60 are inserted into the cylinder bores 8 or 58 via the guide bores 41 of the piston-assembling jig 40 by applying a pressure to the respective pistons 9 or 59 to move the pistons deep into the cylinder bores 8 or 58. At this stage, it should be understood that the pistons 9 or 59 fitted with the piston rings 10 or 60 are preliminarily assembled with a cam plate (a swash plate) 11 or 61 mounted on the drive shaft 6 or 56 to form a piston unit.

The non-compressed piston rings 10 or 60 fitted on the pistons 9 or 59 are then gradually guided by the oblique faces 42 of the piston-assembling jig 40 and the oblique face portions 81 formed in the bore ends of the respective cylinder bores 8 or 58 so as to smoothly reduce the diameter of the respective piston rings 10 or 60 in response to the insertion of the pistons 9 or 59 into the cylinder bores 8 or 58. Therefore, the assembling of the pistons 9 or 59 and the piston rings 10 or 60 into the cylinder bores 8 or 58 of the cylinder block 1 or 51 is accomplished in one single assembling process by the use of the piston-assembling jig 40. After completion of the assembly of all pistons 9 or 59 and the piston rings 10 or 60 of the piston unit into the corresponding cylinder bores 8 or 58 of the cylinder block 1 or 51, the two halves of the piston-assembling jigs 40 are separated from one another in a direction perpendicular to the dividing line P—P of the jig 40. Thus, the piston-assembling jig 40 can be easily detached and removed from the inner end face 1*a* of the cylinder block 1 or 51 without causing any mechanical interference of the jig 40 and the pistons 9 or 59 assembled in the cylinder bores 8 or 58.

From the foregoing description of the assembling method of the pistons 9 or 59 and the piston rings 10 or 60 of the piston unit, it will be easily understood that due to the utilization of the oblique faces 42 of the piston-assembling jig 40 and the oblique face portions 81 formed in the bore ends of the cylinder bores 8 or 58 of the cylinder block 1 or 51, the piston unit, i.e., the pre-assembly of the pistons 9 (59), the piston rings 10 (60) and the cam or swash plate 11 (61) are easily assembled into the cylinder bores 8 or 58 of the cylinder block 1 or 51 irrespective of whether the piston unit is assembled in the cylinder block 1 of a non-variable capacity piston-operated refrigerant compressor in which axial positions of the respective pistons 9 within the cylinder bores 9 are made different from one another due to the fixed angle of inclination of the cam or swash plate 11 or is assembled in the cylinder block 51 of a variable capacity piston-operated refrigerant compressor in which axial positions of the respective pistons 9 within the cylinder bores 9 are changeable by changing an angle of inclination of the cam plate 61.

In the case of a variable capacity piston-operated refrigerant compressor, it is possible to adjust positions of all pistons 59 of the piston unit so that their piston working ends substantially lie in a plane perpendicular to the axis of the drive shaft 56 on which the cam plate 61 is mounted by changing an angular position of the cam plate 61 before the piston unit is assembled in the cylinder block 51. Therefore, even if the piston-assembling jig 40 has no oblique faces 42 and even if the bore ends of the respective cylinder bores 58 has no oblique face portions 81, when the position-adjusted pistons 59 of the piston unit are brought into the bore ends of the corresponding cylinder bores 58 of the cylinder block 51, and when the two halves of the piston-assembling jig are subsequently fitted around the respective pistons 59 so as to apply a compression to the piston rings 60 and to reduce the diameter of the piston rings 60, all pistons 59 and the diameter-reduced pistons rings 60 are easily moved into the cylinder bores 58. Thus, the assembly of the pistons 59 fitted with the piston rings 60 into the cylinder bores 58 of the cylinder block 51 of a variable capacity piston-operated refrigerant assembly can be accomplished by using the piston-assembling jig 40 even if the guide bores 41 of the jig 40 have no oblique faces 42.

It will be understood from the foregoing description of the various embodiments of the present invention that the plurality of pistons fitted with piston rings therein and accommodated in a piston-operated refrigerant compressor irrespective of the capacity being constant and variable, can be easily and in turn effectively assembled in a corresponding number of cylinder bores of a cylinder block by provision of a characteristic boss portion in the inner end face of the cylinder block confronting the crank chamber of the refrigerant compressor and by the use of a specified piston-assembling jig.

It should be understood that various changes or modification will occur to a person skilled in the art without departing from the scope and spirit of the invention as claimed in the accompanying claims.

What we claim is:

1. A piston-operated refrigerant compressor comprising:

a cylinder block having a central axis and a plurality of cylinder bores arranged in parallel with one another and equiangulary around the central axis;

a drive shaft rotatably supported in a central portion of said cylinder block and supporting thereon a cam plate to be rotatable together with said drive shaft within a crank chamber; and a plurality of pistons fitted in said cylinder bores of said cylinder block to be reciprocated in said cylinder bores in association with the rotation of said cam plate, each of said plurality of pistons being fitted with a piston ring in a circumferential groove formed therein, wherein said cylinder block is centrally provided with an inner end face confronting an interior of said crank chamber and having bore ends of said plurality of cylinder bores lying therein, said inner end face being centrally provided with a boss portion axially projecting into the interior of said crank chamber and defining a circularly extending lip portion of each of said bore ends of said cylinder bores to urge said piston together with said piston ring into the corresponding cylinder bore when assembling said piston and said piston ring into the corresponding cylinder bore.

2. The piston-operated refrigerant compressor according to claim 1, wherein said boss portion of said cylinder block is formed to have a round outer circumference, the diameter of which being substantially equal to that of a circle passing respective centers of said plurality of cylinder bores of said cylinder block.

3. The piston-operated refrigerant compressor according to claim 2, wherein said round outer circumference of said boss portion extends around said central axis of said cylinder block.

4. The piston-operated refrigerant compressor according to claim 1, wherein said bore ends of said plurality of cylinder bores, lying in said inner end face of said cylinder block, are provided with a permissible amount of chamfer, respectively.

5. The piston-operated refrigerant compressor according to claim 1, wherein said piston ring fitted on said piston is made of a metallic material consisting of a steel system material.

6. The piston-operated refrigerant compressor according to claim 1, wherein said cam plate rotatably supported on said drive shaft comprises a swash plate element mounted to have a fixed angle of inclination with respect to a plane perpendicular to the axis of rotation of said drive shaft, so that said refrigerant compressor is a constant capacity piston-operated refrigerant compressor.

7. The piston-operated refrigerant compressor according to claim 1, wherein said cam plate rotatably supported on said drive shaft comprises a swash plate element mounted to have a variable angle of inclination with respect to a plane perpendicular to the axis of rotation of said drive shaft, so that said refrigerant compressor is a variable capacity piston-operated refrigerant compressor.

8. The piston-operated refrigerant compressor according to claim 1, wherein said circularly extending lip portion of said each bore end of said cylinder bore defined by said boss portion of said cylinder block is formed as a generally outwardly diverging oblique face viewing from the interior of said each cylinder bore.

9. A method of assembling a piston-operated refrigerant compressor including: a cylinder block having a central axis and a plurality of cylinder bores arranged in parallel with one another and equiangularly around the central axis; a drive shaft rotatably supported in a central portion of said cylinder block and supporting thereon a cam plate to be rotatable together with said drive shaft within a crank chamber; and a plurality of pistons fitted in said cylinder bores of said cylinder block to be reciprocated in said cylinder bores due to a rotation of said cam plate, each of said plurality of pistons being fitted with a piston ring in a circumferential groove formed therein, respectively, said cylinder block being centrally provided with an inner end face confronting an interior of said crank chamber and having bore ends of said plurality of cylinder bores lying therein, said inner end face being centrally provided with a boss portion axially projecting into the interior of said crank chamber and defining a circularly extending lip portion of each of said bore ends of said cylinder bores for promoting said piston together with said piston ring to be inserted into said cylinder bore, wherein the method is characterized by a process of assembling said pistons fitted with said piston rings into said respective cylinder bores, the process comprising the steps of:

preparing a piston-assembling jig separable into two halves and provided with guide bores, each having the shape of an arcuate bore smaller than a semi-circular bore and having a bore diameter thereof substantially the same as that of said each cylinder bore, said guide bores being able to come into registration with radially outer arcuate portions of all of the plurality of said cylinder bores of said cylinder block when said piston-assembling jig is brought into contact with said inner end face of said cylinder block;

attaching said piston-assembling jig to said inner end face of said cylinder block so that guide bores are in registration with all of said bore ends of said cylinder bores of said cylinder block;

inserting said pistons and said piston rings into said respective cylinder bores via said guide bores of said piston-assembling jig while compressing the respective piston rings by the cooperation of said guide bores and said circularly extending lip portions of said bore ends of said cylinder bores to thereby reduce the diameter of said piston rings; and, after inserting all of said pistons fitted with said piston rings into said respective cylinder bores, separating said piston-assembling jig into the two halves to detach said piston-assembling jig from said inner end face of said cylinder block.

10. The method according to claim 9, wherein said bore ends of said plurality of cylinder bores, lying in said inner end face of said cylinder block of said refrigerant compressor, are provided with a permissible amount of a chamfer formed thereat, respectively, and said guide bores of said piston-assembling jig are provided with a chamfered portion sufficient for promoting a smooth reduction in the diameter of said piston rings when said pistons fitted with said piston rings are urged into said respective cylinder bores.

* * * * *